US005217536A

United States Patent [19]

Matsumura et al.

[11] Patent Number: 5,217,536

[45] Date of Patent: Jun. 8, 1993

[54] COMPOSITE PLATING APPARATUS

[75] Inventors: Sowjun Matsumura; Tadashi Chiba; Takayuki Nakamura; Masahiro Saito, all of Hirakata, Japan

[73] Assignee: C. Uyemura & Co., Ltd., Osaka, Japan

[21] Appl. No.: 710,386

[22] Filed: Jun. 5, 1991

[30] Foreign Application Priority Data

Jun. 6, 1990 [JP] Japan ..... 2-147989

[51] Int. Cl.[5] ..... B05C 11/10

[52] U.S. Cl. ..... 118/602; 118/429; 204/238; 204/276

[58] Field of Search ..... 118/429, 602, 603; 204/238, 276

[56] References Cited

U.S. PATENT DOCUMENTS

| | | | |
|---|---|---|---|
| 1,740,979 | 12/1929 | Golrick | 118/602 |
| 3,045,315 | 7/1962 | Dusenbury | 118/602 |
| 3,117,064 | 1/1964 | Friedrich | 118/429 |
| 4,362,123 | 12/1982 | Yamazaki et al. | 118/603 |
| 4,634,503 | 1/1987 | Nogavich | 204/27 |
| 4,805,553 | 2/1989 | Krulik | 118/429 |

FOREIGN PATENT DOCUMENTS

| | | |
|---|---|---|
| 3333121 | 3/1985 | Fed. Rep. of Germany . |
| 2120679 | 12/1983 | United Kingdom . |

*Primary Examiner*—W. Gary Jones
*Assistant Examiner*—Steven P. Griffin

[57] ABSTRACT

A composite plating apparatus includes a plating tank for receiving therein a composite plating solution containing water-insoluble particles or fibers and a reservoir disposed adjacent the plating tank through an overflow weir, preferably in a common housing, the plating solution flowing into the reservoir in an overflow manner. A pump is disposed within the reservoir having a suction port for drawing the solution in the reservoir and a discharge port for pumping the solution. A conduit connected to the pump discharge port extends therefrom over the bottom of the plating tank through the overflow weir and includes a plurality of orifices. The plating solution is circulated by causing the solution to flow over the weir from the plating tank to the reservoir, pumping the solution to the conduit, and injecting the solution into the tank through the orifices to uniformly agitate the solution.

4 Claims, 5 Drawing Sheets

COMPOSITE PLATING APPARATUS

This invention relates to a composite plating apparatus for forming a composite plate film by codepositing water-insoluble materials such as inorganic or organic particles or fibers in a metal deposit matrix.

BACKGROUND OF THE INVENTION

Composite plating or codepositing plating is to codeposit water-insoluble materials such as inorganic or organic particles or fibers in a metal deposit to form a composite film in which the particles or fibers are dispersed in the metal matrix. For uniformly codepositing the particles or fibers in the plating film, it is important to keep the particles or fibers uniformly dispersed in the plating solution.

A plating apparatus of the pump agitation type is known in the prior art for effectively conducting composite plating. A pump is connected to a conduit which is extended along the bottom of a plating tank. Plating solution is circulated by a pump through the conduit to form solution streams to thereby agitate the plating solution so that the particles or fibers may be uniformly dispersed in the plating solution.

This plating apparatus is based on an agitation mechanism using a pump located outside the tank which draws the plating solution in the tank and returns it to the tank by injecting it at the tank bottom. With this mechanism, pump suction tends to induce turbulent and vortex flows in the tank solution, sometimes interfering with the uniform dispersion of particles or fibers in the plating solution.

A modified version of composite plating apparatus for preventing occurrence of turbulent and vortex flows in the plating solution due to pump suction is illustrated in FIG. 5 as comprising a plating tank (a) and a reservoir (b) disposed adjacent the plating tank. A circulating pump (d) is disposed outside the tank and reservoir and has connected thereto a suction conduit (e) and a discharge conduit (h) followed by a spray conduit (g) having a plurality of orifices (g). The pump (d) is effective for returning the plating solution (c) from the reservoir (b) to the plating tank (a) through the conduits. This composite plating apparatus of the overflow type, however, is relatively large in size because it requires space for installing the pump and piping.

SUMMARY OF THE INVENTION

The present invention has been made to overcome the problems of the prior art, and its object is to provide a composite plating apparatus of the pump agitation type which helps uniformly disperse water-insoluble materials such as inorganic or organic particles or fibers in a plating solution and meets compactness requirements.

According to the present invention, there is provided a composite plating apparatus of the pump agitation type comprising a plating tank for receiving therein a composite plating solution containing a metal salt and water-insoluble materials to be codeposited. A reservoir is disposed adjacent the plating tank through an overflow weir so that the plating solution may flow into the reservoir in an overflow manner. Disposed within the reservoir is a pump having a suction port for drawing the plating solution in the reservoir and a discharge port for pumping the solution. A conduit is connected at one end to the discharge port of the pump and extends therefrom over the interior bottom of the plating tank through the overflow weir. The conduit includes a plurality of longitudinally spaced apart orifices for injecting the plating solution from the pump into the tank.

In one preferred embodiment, a net is disposed at an upper portion of the reservoir so as to cover the reservoir for removing bubbles from the overflowing solution. The net is inclined downward from the top of the overflow weir at an angle of 5° to 60°, especially 15° to 45° with respect to a horizontal direction.

The composite plating apparatus of the invention is operated by placing a workpiece to be plated in the composite plating solution in the plating tank. The pump functions to pump the plating solution from the reservoir to the conduit and inject the solution into the tank solution through the orifices in the conduit on the tank bottom, thereby creating solution streams in the tank solution to agitate the tank solution so that the water-insoluble materials such as particles or fibers may be uniformly dispersed in the plating solution during plating. As the plating solution is introduced from the overflow reservoir, the plating solution in the tank is increased in volume. The increment of plating solution will run over the overflow weir and enter the reservoir. The solution entering the reservoir is again pumped to the plating tank through the conduit. This solution circulation is continued during plating.

Since the composite plating apparatus of the invention is based on the pump agitation system using an overflow reservoir, the apparatus helps uniformly disperse particles or fibers in a plating solution while eliminating the occurrence of turbulent and vortex flows in the tank solution due to pump suction. As a result, there are obtained satisfactory composite plating films having particles or fibers uniformly codeposited in the metal matrix. Since the pump is located within the overflow reservoir and the conduit extends from the reservoir directly into the plating tank through the overflow weir, no special space is needed for the installation of the pump and its piping. Thus the composite plating apparatus of the pump agitation type using an overflow reservoir can be implemented to a compact size, eliminating the problem of the prior art apparatus that the apparatus as a whole is increased in size by installing the agitation mechanism.

Several benefits are obtained from the arrangement that the circulating pump, which may be of the semi-submerged type is disposed within the overflow reservoir and the conduit is disposed on the tank bottom for injecting the pump discharge solution into the plating tank. The head of the solution in the reservoir can be effectively utilized as part of the pressure for injecting the solution into the tank. The pump discharge solution is introduced into the tank only through the conduit with a minimum loss of the injection pressure through the conduit. This ensures efficient and stable liquid circulation with an attendant saving of the pump operating energy. The head of the solution in the reservoir is readily controllable by properly adjusting the surface level of the solution therein. The solution circulation system is easy to maintain since only the pump and the conduit connecting the pump and the tank need to be taken care of.

In general, a relatively large proportion of a surface active agent is added to the composite plating solution for helping uniformly disperse particles or fibers in the solution. As a result, many bubbles can be formed due to pump agitation. Particularly when the composite plating solution is an electroless nickel plating solution, a substantial volume of hydrogen gas evolves during the chemical plating reaction, causing a large amount of bubbles to form. If the bubbling solution is passed to the reservoir without bubble removal, bubbles are drawn by the pump and conducted to the tank solution, often causing some deficiencies, for example, gas pits or voids in plating films. This inconvenience can be avoided by debubbling means. More particularly, a net is disposed at an upper portion of the reservoir so as to cover the reservoir for removing bubbles from the overflowing solution. Even if the solution is bubbling, bubbles are removed upon transfer of the solution from the tank to the reservoir through the debubbling net. Thus, the solution in the reservoir is free of bubbles and no bubbles are drawn by the pump. More efficient debubbling is achieved when the net is inclined downward from the top of the overflow weir at an angle of 5° to 60°, especially 15° to 45° with respect to a horizontal direction.

BRIEF DESCRIPTION OF THE DRAWINGS

The above and other objects, features, and advantages of the present invention will be better understood from the following description taken in conjunction with the accompanying drawings, in which.

DESCRIPTION OF THE PREFERRED EMBODIMENTS

Figure 1:
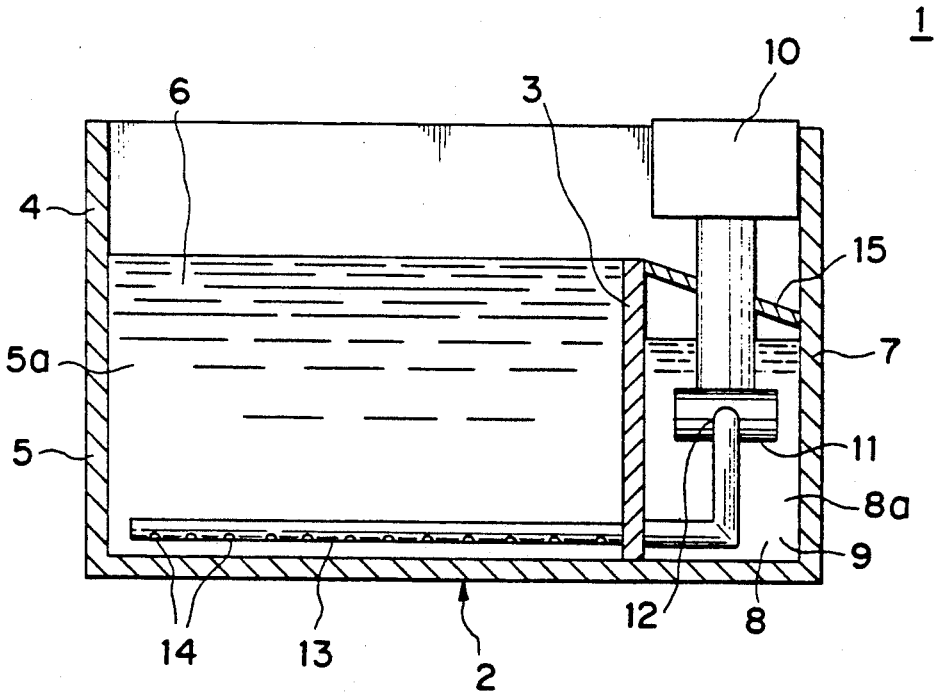
FIG. 1 is a schematic cross section of a composite plating apparatus according to one embodiment of the present invention.

Referring to FIG. 1, there is illustrated a composite plating apparatus according to one embodiment of the present invention generally designated at 1. The apparatus 1 is applicable to either composite electroplating or composite electroless plating. The apparatus 1 includes a housing or enclosure 2 of generally rectangular box shape having four side walls and a bottom. It will be understood that the side walls are generally vertical and the bottom wall is generally horizontal. An overflow weir or partition 3 which is lower than the housing side walls is disposed in the housing 2 to extend between a pair of opposed side walls, thereby partitioning the housing interior into two sections. A plating tank 5 is defined between the weir 3 and one opposed side wall 4 (left wall in FIG. 1) and an overflow reservoir 8 is defined between the weir 3 and the other opposed side wall 7 (right wall in FIG. 1). The plating tank 5 defines an interior (plating) chamber 5*a* which is filled with a plating solution 6 containing water-insoluble materials such as particles or fibers, typically organic or inorganic particulates up to a height corresponding to the weir 3. The reservoir 8 defines an interior (overflow) chamber 8*a* which receives the solution 6 flowing over the weir from the plating tank 5. The reservoir solution 9 in the reservoir 8 is at a lower level than the solution 6 in the tank 5. Disposed in the reservoir 8 is a pump in the form of a vertical seal-free pump 10 having a suction port 11 immersed in the reservoir solution 9 and a discharge port 12. A general L-shaped conduit 13 includes a vertical section connected to the pump discharge port 12 and a horizontal section extending from the reservoir 8 to the tank 5 through the weir 3 at the lower end. The conduit 13 extending along the bottom of the tank 5 includes a plurality of longitudinally spaced apart orifices 14 facing the tank bottom. The pump 10 has a pumping function of drawing the reservoir solution 9 from the reservoir 8 through the suction port 11, pumping the solution through the conduit 13, and then forcedly injecting the solution toward the tank bottom through the orifices 14.

A net 15 is disposed at an upper portion of the reservoir 8 so as to cover the reservoir for removing bubbles from the overflowing solution. Preferably, the net 15 is inclined downward from the top of the weir 3 to the other side wall 7 at an angle of 5° to 60°, especially 15° to 45° with respect to a horizontal direction.

The debubbling net 15 may be a screen of metal or plastic material or a sheet of metal or plastic material having a number of perforations or slits formed therein. Preferably, the net 15 has a mesh or pore size of about 0.5 to about 5 mm or a slit width of about 0.5 to about 5 mm.

Not shown in the plating apparatus of FIG. 1 are elements associated with composite plating, for example, bars for supporting workpieces, an anode and anode bus bar in the case of electroplating, and a heater.

Composite plating is carried out in the composite plating apparatus 1 of FIG. 1 by immersing a workpiece (not shown) in the plating solution 6 in the tank 5. The pump 10 is actuated to draw the reservoir solution 9 through the suction port 11, pump the solution through the conduit 13, and then forcedly inject the solution into the tank solution 6 through the conduit orifices 14, thereby creating solution streams in the tank solution 6. The tank solution 6 is agitated by the solution streams from the bottom so that the functional constituent is uniformly dispersed in the solution 6. Plating is effected in the uniformly agitated solution. As the reservoir solution 9 is introduced into the tank 5, the tank solution 6 increases its surface and incrementally flows over the weir 3, passing from the tank 5 to the reservoir 8. Then the solution is returned to the tank 5 again by means of the pump 10 through the conduit 13.

With the above-mentioned arrangement of the composite plating apparatus 1, the plating solution is taken in from the overflow reservoir 8 and injected into the plating tank 5 for the purpose of pumping agitation both using the pump 10. Since the functions of drawing and injecting the solution are carried out separately in the reservoir and the tank, respectively, the pump suction of plating solution does not cause any turbulence or vortex in the tank solution 6. The tank solution 6 is smoothly agitated by the streams injected from the conduit 13 so that the water-insoluble particles or fibers to be codeposited are uniformly dispersed in the solution 6. Since the pump discharge solution is injected toward the bottom of the tank 5 through the orifices 14 in the conduit 13 on the tank bottom, the particles or fibers are uniformly dispersed in the solution 6 without stagnation of the particles or fibers on the bottom or at the corners of the tank 5. As a result, there are obtained composite plating films having the particles or fibers uniformly codeposited in the metal matrix. In addition, the quantity of the particles or fibers codeposited is increased.

Since the pump 10 is located within the overflow reservoir 8 and the conduit 13 extends from the reservoir 8 directly into the plating tank 5 through the weir 3, no special space is needed for the installation of the pump and its piping. Thus the composite plating apparatus can be made compact without reducing the volume of the plating tank 5.

Since the circulating pump 10 is disposed within the reservoir 8 and the conduit 13 is closely spaced from the tank bottom for injecting the pump discharge solution into the plating tank 5 at the bottom, the head of the reservoir solution 9 can be effectively utilized as part of the pressure for injecting the solution into the tank 5. Since the pump discharge solution is introduced into the tank 5 only through the conduit 13, the loss of the injection pressure through the conduit is minimized. Thus efficient and stable liquid circulation takes place and the pump operating energy is saved. The head of the solution in the reservoir 8 is readily controllable by properly adjusting the surface level of the reservoir solution 9 therein. The solution circulation system is easy to maintain since only the single conduit 13 is needed.

The debubbling net 15 is provided in the reservoir 8 near its top. Where many bubbles are formed on the tank solution 6 and such bubbling solution overflows into the reservoir 8 along with bubbles, the net 15 is effective in removing the bubbles from the overflowing solution. Then the reservoir solution 9 is free of bubbles and there is not risk of the pump 10 taking in bubbles.

The composite plating apparatus of the invention is compatible with either electroplating or electroless plating. The plating solutions which can be used herein include conventional well-known plating solutions having a metal ion dissolved and a water-insoluble material suspended therein, depositing a composite plating film having the water-insoluble material codeposited with the metal on a workpiece. As the plating solution, there are included electroplating solutions such as nickel plating solutions (Watt and sulfamate baths, etc.), copper plating solutions, zinc plating solutions, and similar alloy plating solutions. Included in the electroless plating solutions are nickel and copper plating solutions containing a reducing agent. All these solutions may have well-known compositions and well-known plating conditions are employable.

The water-insoluble particles or fibers dispersed in the plating solution to be codeposited are not limited. Examples of water-insoluble materials include organic resin particles such as phenol resins, epoxy resins, polyamide resins, rubber latexes, and fluorocarbon resins including polytetrafluoroethylene, inorganic particles such as fluorinated graphite, silicon carbide, and alumina as well as fibers. The particles may have an average particle size of about 0.1 to about 200 μm. The fiber may have a length of about 0.5 to about 500 μm. The particles or fibers may be added to the plating solution in an amount of about 0.1 to about 200 grams/liter, particularly about 10 to 150 grams/liter.

To disperse the water-insoluble material in a plating solution, surface active agents including cationic, nonionic, amphoteric and anionic surface active agents may be added. Preferred surface active agents are fluorochemical cationic surface active agents and fluorochemical amphoteric surface active agents. The surface active agents may preferably be added in an amount of about 0.1 to about 10 grams/liter, more preferably about 0.3 to 5 grams/liter.

Figure 2:
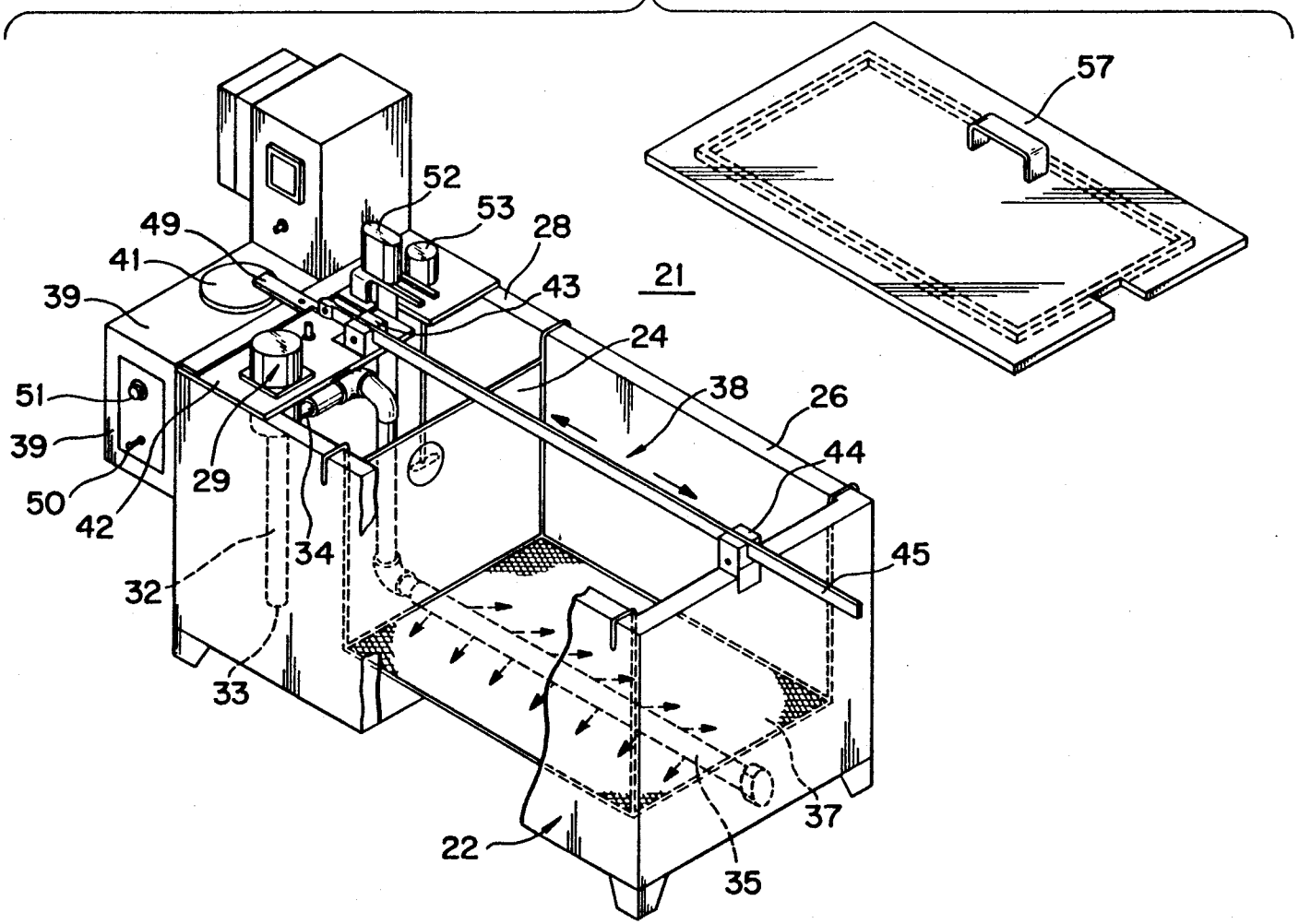
FIG. 2 is a partially cut-away, perspective view of an apparatus according to another embodiment of the present invention.
Figure 3:
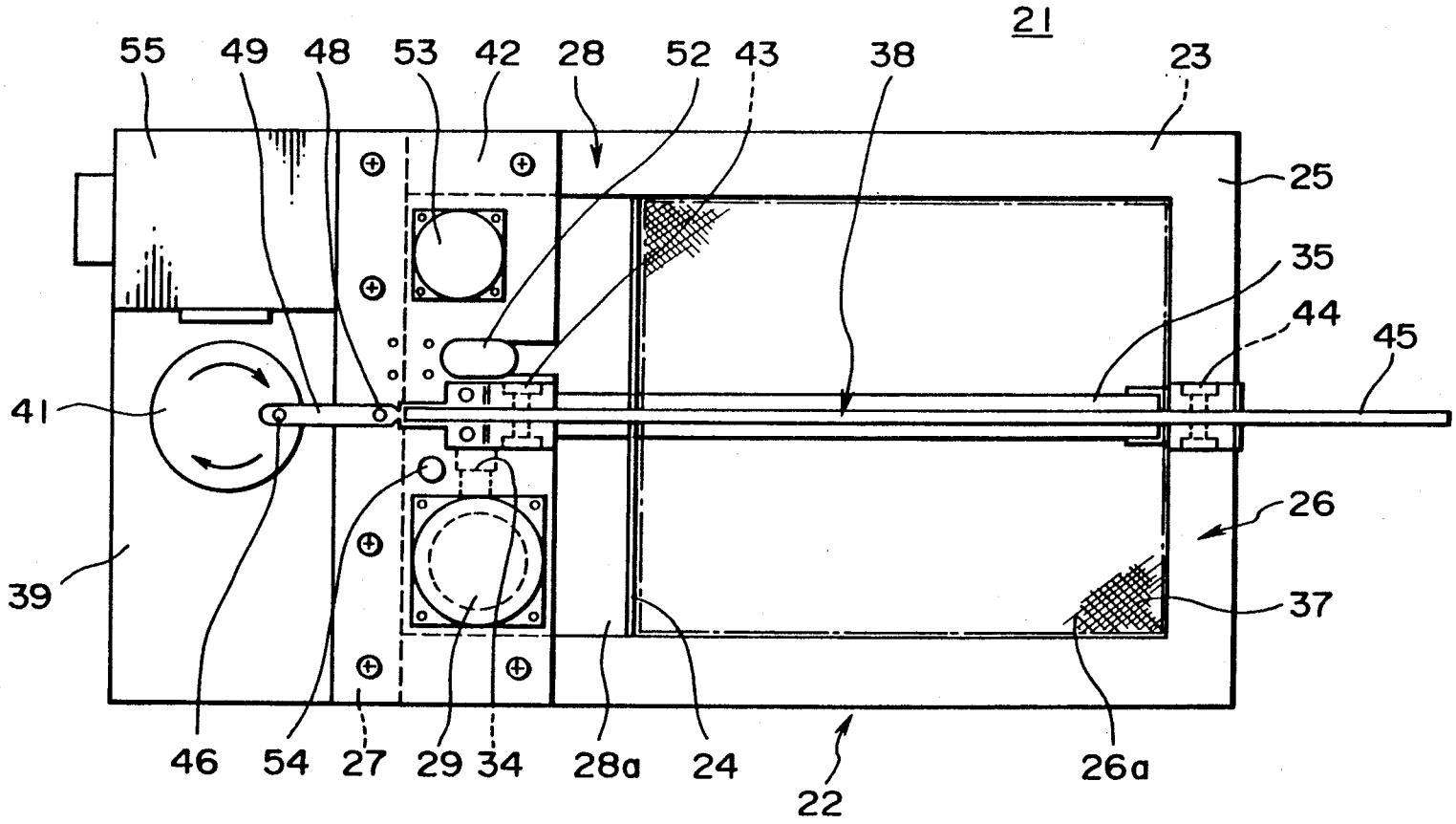
FIG. 3 is a plan view of the apparatus of FIG. 2.
Figure 4:
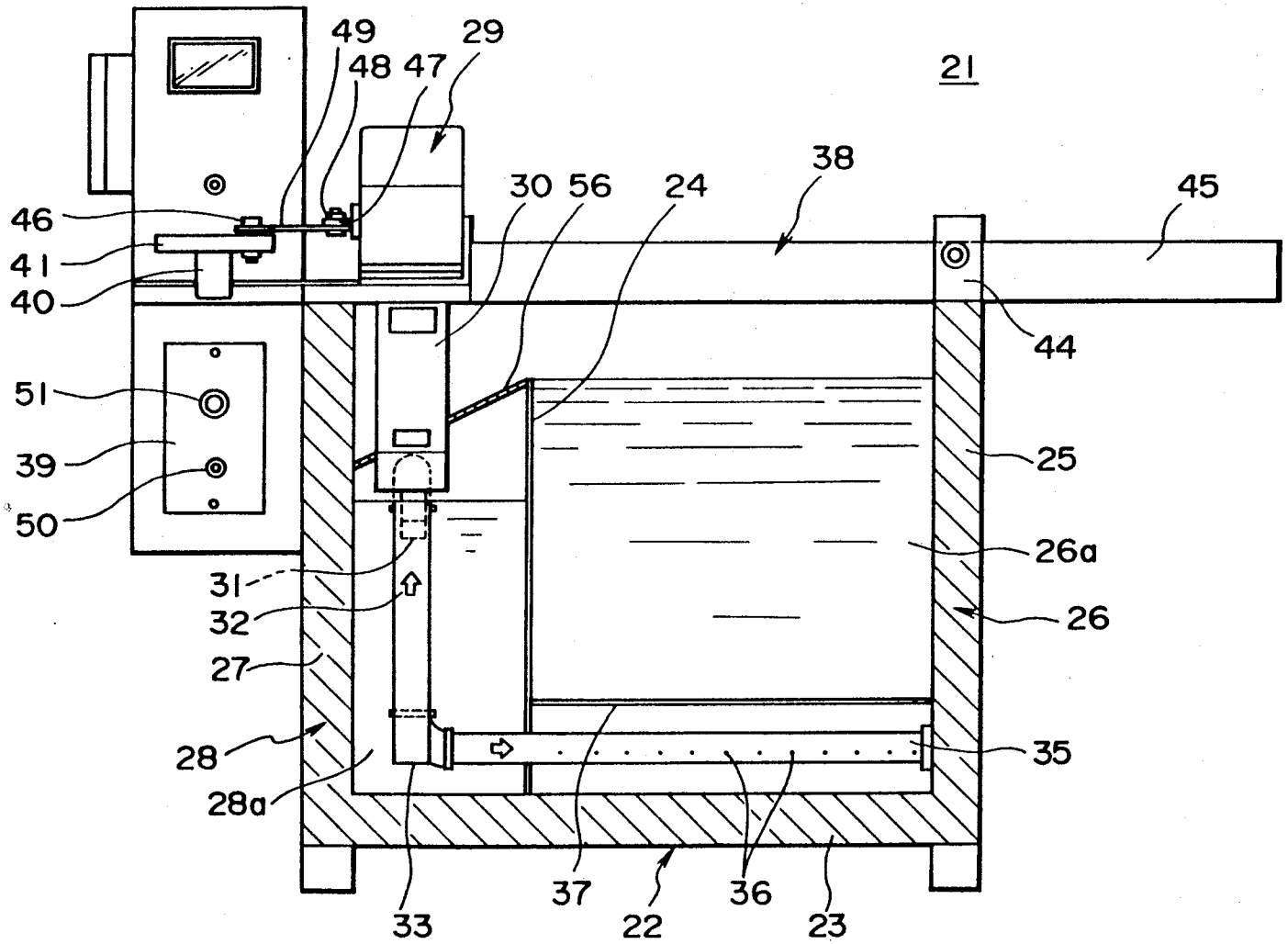
FIG. 4 is a longitudinal cross section of the apparatus of FIG. 2.
Figure 5:
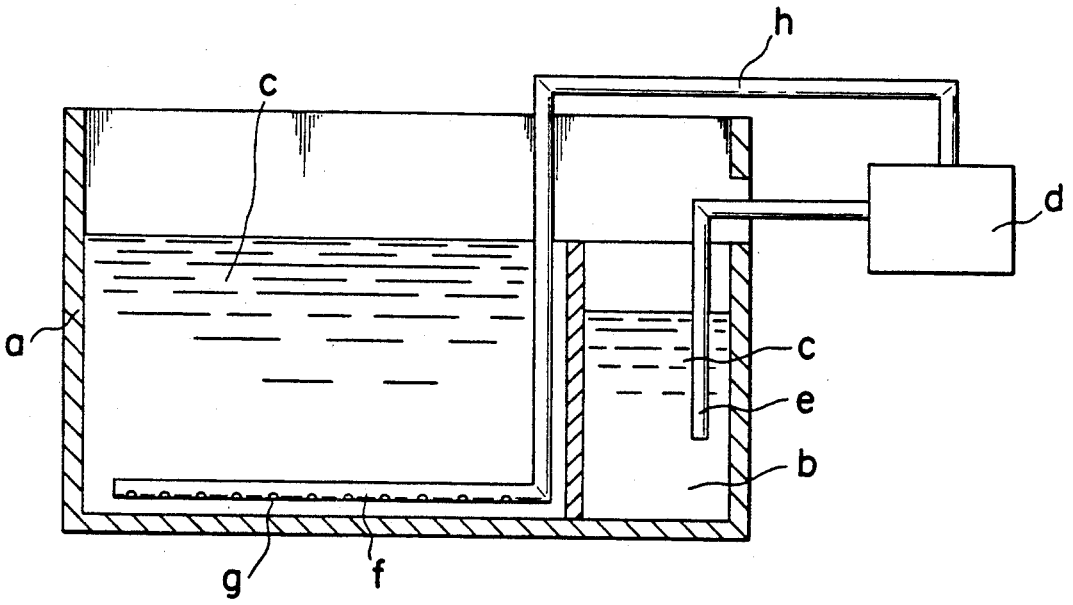
FIG. 5 PRIOR ART
FIG. 5 is a schematic cross section of a prior art composite plating apparatus.

FIGS. 2 to 4 show a more practical version of the composite plating apparatus according to the present invention, which is constructed herein for electroless composite plating.

The electroless composite plating apparatus generally depicted at 21 includes a housing or enclosure 22 having walls which are covered for protection with insulating material 23 such as glass wool. An overflow weir 24 is disposed in the housing to define a plating tank 26 with one side wall 25 and an overflow reservoir 28 with another side wall 27. That is, the weir 24 partitions the housing interior into plating and reservoir chambers 26*a* and 28*a*, respectively.

A pump 29 is disposed in the reservoir 28. The pump 29 includes a downward extending pump body 30 having an inlet port 31 which is connected to an inlet pipe 32 extending further downward from the body and terminating at a lower opening 33. The pump body 30 on the rear side has an outlet port 34 which is connected to a rise section of a generally L-shaped conduit 35 of stainless steel. The conduit 35 passes through the weir 24 at the bottom center and extends through the tank along a bottom longitudinal center line thereof with a small spacing from the tank bottom until it reaches the one side wall 25. The conduit 35 includes a plurality of longitudinally spaced, downward oriented orifices 36. Preferably two rows of orifices 36 are provided on opposite sides of the conduit 35 so as to obliquely face the tank bottom. With the above-mentioned arrangement, the plating solution in the reservoir 28 is drawn into the pump body 30 through the inlet pipe 33 and port 31. The pump then pumps the solution from the outlet port 34 through the conduit 35, thereby injecting the solution obliquely toward the tank bottom through the orifices 36.

Further provided in the plating tank 26 is an agitating/turbulent flow inducing net 37 of stainless steel which is extended somewhat above the conduit 35. This net 37 is effective in rendering the flow of the plating solution in the tank random or indefinite and preventing the injected streams from directly impinging against the workpiece(s), thus assisting in depositing even plating films of uniform color tone on the workpiece(s).

Also provided is a rocking assembly 38 including a rocking control unit 39, a rotating shaft 40, a rotating disk 41, supports 43 and 44, a rocking bar 45, and a rocking arm 49. The control unit 39 is fixedly secured to the housing 22 on the outside. The rotating shaft 40 is connected to a motor through a gearbox (not shown) in the control unit 39. The rotating disk 41 is attached to the shaft 40. The support 43 is secured to a base plate 42 at the center which is bolted to the housing walls at the top to partially cover the reservoir 28. Another support 44 is secured to the one housing side wall 25 at the top. The rocking bar 45 is supported for longitudinal slide motion by these supports 43 and 44. The rocking arm 49 is pivotally connected at one end to the rotating disk 41 near its periphery by a pin 46 and at another end to a connecting member 47 extending from the rocking bar 45 by a pin 48. A rack having mounted workpieces to be plated (not shown) is suspended from the rocking bar 45.

The rocking assembly 38 operates as follows. A switch 50 on the control unit 39 is turned on to actuate the motor to drive the rotating shaft 40 and the rotating disk 41 therewith. The rotational motion is converted into a linear motion through the rocking arm 49 so that the rocking bar 45 is longitudinally moved back and forth. In accordance with the reciprocal motion of the rocking bar 45, the rack and workpieces held therein are moved back and forth. The speed of this reciprocal motion is controllable by manipulating a speed control volume 51 on the control unit 39 to change the gear ratio of the gear box.

Also shown in FIGS. 2, 3, and 4 are a heater 52, an agitator 53, and a temperature sensor 54. These elements are disposed on the support plate 42 and associated with the reservoir 28. Provision is made such that the heater 52 and agitator 53 are turned on and off by manipulating a switch on the control box 55.

Further, a debubbling net 56 is provided near the top of the overflow reservoir 28. As shown in FIG. 4, though not shown in FIGS. 2 and 3, the net 56 is downward inclined from the top of weir 24 toward the other housing side wall 27.

A cover 57 is fitted over the housing 22 to close the top opening thereof for the purposes of thermal insulation and environmental pollution control by preventing a substantial amount of gases evolving during electroless plating from escaping outside as mist.

As previously mentioned, the apparatus shown in FIGS. 2 to 4 is adapted for electroless plating, especially electroless composite nickel plating at a bath temperature of 60° to 95° C. The same benefits as in the apparatus of FIG. 1 are obtained with the use of the pump 29 and debubbling net 56. The difference is the provision of the heater 52 in the overflow reservoir 28 and the agitator 53 in proximity thereto. The plating solution is heated in the reservoir 28 rather than in the plating tank 26 while the agitator 53 is effective for preventing local heating of the solution near the heater 52 and degradation thereof. Since it is the solution in the reservoir 28 that is agitated by the agitator 53, no influence like agitator induced trubulent flow is imparted to the solution in the plating tank 26.

Agitation of the plating solution in the plating tank 26 is achieved by the solution flow induced by the pump 29 without any influence of agitation of the solution in the reservoir 28 by the agitator 53. In addition, the workpieces can be moved back and forth in a longitudinal direction of the rocking bar 45 by operating the rocking assembly 38. There are obtained composite plating films having particles or fibers uniformly codeposited therein.

Although some preferred embodiments have been described, many modifications and variations may be made thereto in the light of the above teachings. For example, although a seal-free pump as used in the embodiment is preferred, any other pumps such as pumps using a grand packing and mechanical seal and submerged pumps may be used. A plurality of conduits may be used. The bottom edges and corners of the plating tank can be formed at an obtuse angle or rounded so that the plating solution may smoothly flow thereat.

There has been described a composite plating apparatus which uses a pump agitation system in combination with an overflow reservoir and can agitate a plating solution without causing turbulence or vortex while helping uniformly disperse a codepositing component (particles or fibers) in the plating solution. As a result, there are obtained satisfactory composite plating films having particles or fibers uniformly codeposited in the metal matrix. Since the pump is located within the reservoir and the conduit extends from the reservoir directly into the plating tank through the overflow weir, no special space is needed for the installation of the pump and its piping. Thus, the composite plating apparatus can be made compact without restricting the volume of the plating tank.

Since the circulating pump is disposed within the reservoir and the conduit is disposed on the tank bottom for injecting the pump discharge solution into the plating tank, the head of the solution in the reservoir can be effectively utilized as part of the pressure for injecting the solution into the tank. Since the pump discharge solution passes through only the conduit before entry to the tank, the loss of the injection pressure through the conduit is minimized. This ensures efficiency and stability of liquid circulation as well as saving of the pump operating energy. Maintenance is quite easy since the conduit connecting the pump to the plating tank is the only piping.

Furthermore, the bubbling problem can be avoided by providing a debubbling net over the reservoir for removing bubbles from the overflowing solution. The solution in the reservoir is free of bubbles and no bubbles are drawn by the pump.

We claim:

1. A composite plating apparatus comprising a plating tank for receiving therein a composite plating solution containing a water-insoluble material to be codeposited, a reservoir disposed adjacent the plating tank through an overflow weir, the plating solution flowing into the reservoir in an overflow manner, a pump disposed within the reservoir and having a suction port for drawing the plating solution in the reservoir and a discharge port for pumping the solution, a conduit connected at one end to the discharge port of said pump and extending therefrom over the bottom of said plating tank through the overflow weir, the conduit including a plurality of longitudinally spaced apart orifices for injecting the plating solution from the pump into said plating tank, and an agitating/turbulent flow inducing net for rendering the flow of the plating solution in the plating tank random or indefinite and preventing the injected stream from directly impinging against a workpiece or workpieces to be plated after injecting the plating solution from the orifices of the conduit, thus assisting in depositing even plating films of uniform color tone on the workpiece(s).

2. The apparatus of claim 1 further comprising a net disposed at an upper portion of said reservoir so as to cover the reservoir for removing bubbles from the overflowing solution.

3. The apparatus of claim 2 wherein the net is inclined downward from the top of the overflow weir at an angle of 5 to 60 degrees with respect to a horizontal direction.

4. The apparatus of claim 1 wherein a single housing is partitioned by the weir into the plating tank and the reservoir.

* * * * *